United States Patent [19]

Sonderb k

[11] Patent Number: 4,780,978

[45] Date of Patent: Nov. 1, 1988

[54] INFORMATION-CARRYING SIGN WITH HIDDEN SECUREMENT

[75] Inventor: Lauge Sonderb k, Fredensborg, Denmark

[73] Assignee: Dansign V/Lauge Sonderbaek, Copenhagen, Denmark

[21] Appl. No.: 15,135

[22] PCT Filed: May 28, 1986

[86] PCT No.: PCT/DK86/00058

§ 371 Date: Jan. 29, 1987

§ 102(e) Date: Jan. 29, 1987

[87] PCT Pub. No.: WO86/07176

PCT Pub. Date: Dec. 4, 1986

[30] Foreign Application Priority Data

May 30, 1985 [DK] Denmark ..... 2429/85

[51] Int. Cl.[4] ..... G09F 7/00

[52] U.S. Cl. ..... 40/584; 40/655

[58] Field of Search ..... 40/618, 620, 584, 18, 40/17, 15 R, 15 A, 202

[56] References Cited

U.S. PATENT DOCUMENTS

| | | | |
|---|---|---|---|
| 833,247 | 10/1906 | Sampson | 40/618 |
| 1,628,525 | 5/1927 | Bell | 40/15 A |
| 1,953,707 | 4/1934 | French | 40/15 A |
| 2,037,670 | 4/1936 | Wilson | 40/618 |
| 2,221,926 | 11/1940 | Quant | 40/618 |
| 4,357,768 | 11/1982 | DeDube | 40/17 |

FOREIGN PATENT DOCUMENTS

| | | | |
|---|---|---|---|
| 8302516 | 7/1983 | PCT Int'l Appl. | 40/618 |

*Primary Examiner*—Gene Mancene
*Assistant Examiner*—Cary E. Stone
*Attorney, Agent, or Firm*—Scully, Scott, Murphy & Presser

[57] ABSTRACT

A sign device comprises a mounting part and an information-carrying part capable of being pushed onto the mounting part. When mounted the information-carrying part is locked on the mounting part by a hidden magnetic releasable lock which automatically locks the two parts together when the information-carrying part is in correct position on the mounting part. The locking device may consist of a tiltable plate born in a recess in the mounting portion and comprises an upwardly projecting flange for engagement in a correspondingly formed recess in the information-carrying part, the plate at the flange-carrying end being subjected to the influence of a spring in a direction out of the recess. This spring force can only be neutralized by an exterior force from a magnet making the flange-carrying end of the plate move downwardly into the recess and out of engagement with the information-carrying part. As a result the sign device is efficiently protected against attempts to remove the information-carrying part from the mounting part.

5 Claims, 1 Drawing Sheet

INFORMATION-CARRYING SIGN WITH HIDDEN SECUREMENT

TECHNICAL FIELD

The invention relates to a sign device comprising a mounting part and an information-carrying part capable of being pushed onto said mounting part, wherein the mounting part and the information-carrying part comprise mutually cooperating profile portions having the effect that the pushing of the information-carrying part onto the mounting part can only be performed during mutual displacement of substantially planar, mutually abutting surface portions on the mounting part and the information-carrying part, respectively.

BACKGROUND ART

Various sign devices of the above type are known. Such signs are used both as permanent signs and as signs, where the user according to his wishes can replace the information-carrying part with another information-carrying part. These sign devices are generally used without any locking of the information-carrying part in relation to the mounting part, for which reason unauthorized persons can easily remove the information-carrying part. Different methods have consequently been used for locking the two parts together, but the previously known methods have not proved fully satisfactory, either because the information-carrying part has been disfigured by visible screws or because unauthorized persons have nevertheless been able to release the fastening mechanism concerned.

DESCRIPTION OF THE INVENTION

The sign device according to the invention is characterised in that the sign device comprises a hidden magnetically releasable lock adapted to automatically lock the mutually displaceable surface portions together in the pushed-on state of the information-carrying part. As a result a sign device is provided ensuring locking of the two mutually displaceable portions without the visible information-carrying part being disfigured. As a further result, unauthorized persons cannot remove the information-carrying part without having knowledge as to how the magnetically releasable lock is situated, and thus how the magnet in question has to be placed to release the lock.

The lock may according to the invention be a tiltably mounted magnetic plate mounted in a first recess in one of the two mutually displaceable surface portions, and the plate may comprise a projection for locking cooperation with a similarly formed second recess in the second of the two mutually displaceable surface portions, whereby the lock may comprise a spring influencing he magnetic plate in such a manner that the projection will automatically be in engagement with the recess in the second of the two mutually displaceable surface portions in their assembled position. A lock is consequently obtained which is particularly simply and easily constructed.

In a particularly advantageous embodiment of the invention the magnetic plate may be of an oblong, rectangular shape and may be bent around a transverse bending line in close proximity to the center of the plate, and the plate may at each longitudinal side comprise a further outwardly extending projection at the bending line, said projections being received in corresponding notches extending in opposite directions from the first recess in one of the two mutually displaceable surface portions, the notches having such a depth in a direction perpendicular to the corresponding surface portion that the plate is supported in the notches with the bending line being approximately flush with the surface of the surface portion.

The projection of the plate for locking the surface portions together may be an outwardly extending narrow flange along one end of the plate viewed in its longitudinal direction, whereby a lock is obtained, in which the projections of the plate for locking cooperation with the corresponding second recess are particularly simple and function easily during displacement of the two mutually displaceable parts in a direction coinciding with the longitudinal direction of the plate.

Furthermore, according to the invention the spring may be a coiled spring, which is fastened, e.g. by soldering, to the plate on the side facing the bottom of the first recess, and which presses the end of the plate with the projection for locking the surface portions away from the bottom of the first recess by rotating or tilting the plate round its bending line. As a result a magnetically releasable plate with associated spring is obtained which is simple in construction and easy to mount.

Finally according to the invention the tiltably mounted plate with the associated first recess may be connected with a separate module for fastening on the mounting part or the information-carrying part. It is consequently obtained that a module with associated lock of the same size may be produced for use in connection with mounting parts or information-carrying parts of different dimensions, as a recess corresponding to the module should only be available in the part concerned.

BRIEF DESCRIPTION OF THE DRAWING

The invention will be described below with reference to the accompanying drawing, in which.

DESCRIPTION OF THE PREFERRED EMBODIMENTS OF THE INVENTION

Figure 1:
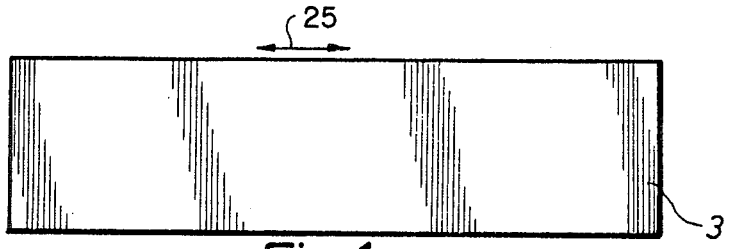
FIG. 1 is a front view of a preferred embodiment of a sign device according to the invention.
Figure 2:
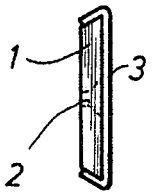
FIG. 2 is a left-hand end view of the sign device of FIG. 1.
Figure 3:
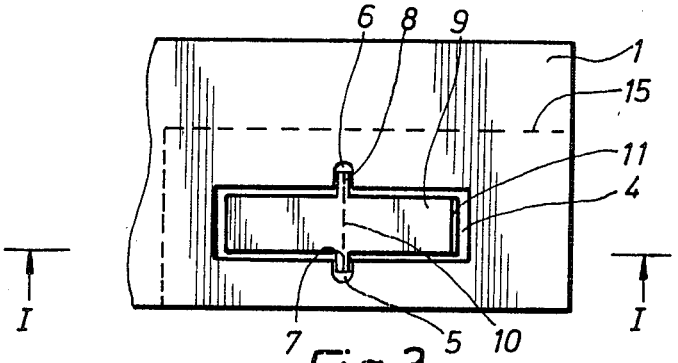
FIG. 3 is on a larger scale a front view of a portion of the sign device illustrated in FIGS. 1 and 2 with the information-carrying part removed.
Figure 4:
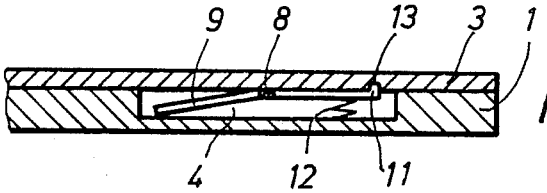
FIG. 4 is a sectional view along the line I—I in FIG. 3 with the information-carrying part in position, and in which a magnetically releasable lock is illustrated in locking position.
Figure 5:
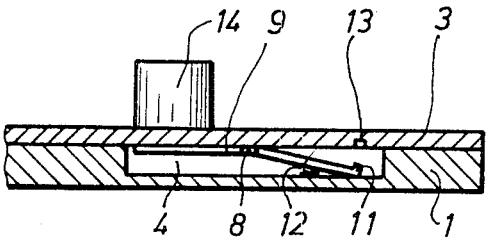
FIG. 5 illustrates the same as FIG. 4 but with the lock released due to a magnet located on top of the information-carrying part.

The sign device illustrated in FIGS. 1–5 comprises a mounting part 1 in the form of an oblong plate, which as indicated by dotted lines in FIG. 2 comprises apertures 2 for fastening the mounting part to a wall by means of screws. The sign device further comprises an information-carrying part 3 in the form of a rail. The mounting part 1 and the information-carrying part 3 are constructed with such a profile (dovetail profile) that the information-carrying part by displacement in the direction illustrated in FIG. 1 by an arrow 25 can be displaced into position on the mounting part 1 to cover said mounting part completely. The mounting part 1 and the information-carrying part 3 are preferably of the same length. A first oblong recess 4 is as particularly illustrated in FIGS. 3–5 formed in the side of the mounting part 1 adapted to face the information-carrying part 3. The recess 4 is at the center of each longitudinal side extending parallel to the longitudinal sides of the mounting part connected with transverse notches 5 and 6, the bottom of which is adapted to support outwardly extending projections 7 and 8 on each side of a magnetic rectangular plate 9, the depth of the notches in a direction perpendicular to the surface of the mounting part 1 approximately corresponding to the thickness of the plate 9. FIGS. 4 and 5 illustrate particularly that the plate 9 comprises a minor bend along a transverse bending line 10 indicated by dotted lines in FIG. 3. At one end the plate 9 further comprises a perpendicularly upright flange 11 and a coiled spring 12 (only illustrated schematically in the drawing) fastened adjacent to said flange 11 but on the opposite side of the plate.

The first recess 4 is of such a depth in a direction perpendicular to the surface of the mounting part that the plate 9 is allowed to tilt freely round a line of revolution, which approximately coincides with the bending line 10, so that one end of the plate 9 may be flush with the surface of the mounting part, while the other end of the plate 9 projects towards the bottom of the recess 4 in one outermost position of the plate 9, and the other end of the plate 9 may be flush with the surface of the mounting part 1, while the first end projects towards the bottom of the recess 4 in the other outermost position of the plate 9.

As illustrated in FIGS. 4 and 5 the information-carrying part 3 carries a second recess 13 for receiving the flange 11 of the plate, and the second recess 13 consequently has the shape of a transverse track in the side of the information-carrying part 3 facing the mounting part 1.

When the magnetic plate 9 is in the position in the first recess 4 and the information-carrying part 3 is pushed into position on top of the mounting part 1, the flange-carrying end of the plate 9 being kept down, while the end of the information-carrying part 3 passes the flange 11, the flange 11 is automatically engaged in the recess 13 when the information-carrying part 3 is in position. The flange 11 remains in engagement with the second recess 13 due to the pressing of the spring 12 until the opposite end of the plate 9 is influenced by a magnet 14 of suitable strength. As illustrated in FIG. 5 the magnet 14 is placed on top of the information-carrying part 3. The correct positioning of the magnet 14 cannot be seen immediately, and the magnet 14 can thus suitably be connected with a tool (not shown) ensuring correct positioning of the magnet 14 relative to predetermined reference edges, e.g. the longitudinal and transverse sides of the information-carrying part.

In a preferred embodiment the described sign device consists of a mounting part of oil hardened masonite and of an information-carrying part of aluminium, whereas the magnetic plate 9 is made of an ordinary steel plate with a thickness of 1.5 mm.

The invention is described with references to a specific embodiment. Many alterations may be made without thereby deviating from the scope of the invention. The mounting part and the information-carrying part of the sign device may thus have many different shapes and dimensions, it being important that the lock is connected with surface portions sliding against each other when the information-carrying part 3 is placed on the mounting part 1. As indicated by dotted lines 15 in FIG. 3 the lock consisting of the plate 9, the recess 4 and the notches 5 and 6 may be in the form of a module with predetermined rectangular dimensions and fitting into a recess in a mounting part of any ordinary size. As a consequence the need has been avoided of having to handle mounting parts of different dimensions in the production of the individual parts for receiving the magnetic plate and its associated parts.

I claim:

1. A sign device comprising a mounting part and an information-carrying part capable of being pushed onto said mounting part, wherein the mounting part and the information-carrying part comprise mutually cooperating profile portions having the effect that the pushing of the information-carrying part onto the mounting part can only be performed during mutual displacement of substantially planar, mutually abutting surface portions on the mounting part and the information-carrying part, respectively, characterised in that the sign device comprises a hidden magnetically releasable lock adapted to automatically lock the mutually displaceable surface portions together in the pushed-on state of the information-carrying part, wherein said lock comprises a tiltably mounted magnetic plate mounted in a first recess in one of the two mutually displaceable surface portions, said plate comprising a projection for locking cooperation with a similarly formed second recess in the second of the two mutually displaceable surface portions, said lock further comprising a spring influencing the magnetic plate in such a manner that the projection will then automatically be in engagement with the recess in the second of the two mutually displaceable surface portions in their assembled position.

2. A sign device as claimed in claim 1, characterised in that the magnetic plate is of an oblong, rectangular shape and is bent around a transverse bending line in close proximity to the center of the plate, and that the plate at each longitudinal side comprises a further outwardly extending projection at the bending line, said projections being received in corresponding notches extending in separate directions from the first recess in one of the two mutually displaceable surface portions, the notches having such a depth in a direction perpendicular to the corresponding surface portion that the plate is supported in the notches with the bending line being approximately flush with the surface of the surface portion.

3. A sign device as claimed in claim 1, characterised in that the projection of the plate for locking the surface portions together is an outwardly extending narrow flange along one end of the plate viewed in its longitudinal direction.

4. A sign device as claimed in claim 1, characterised in that the spring is a coiled spring, which is fastened to the plate on the side facing the bottom of the first recess, and which presses the end of the plate with the projection for locking the surface portions away from the bottom of the first recess by tilting the plate around its bending line.

5. A sign device as claimed in claim 1, characterised in that the tiltably mounted plate with the associated first recess is connected with a separate module for fastening on the mounting part or the information-carrying part.

* * * * *

UNITED STATES PATENT AND TRADEMARK OFFICE

CERTIFICATE OF CORRECTION

PATENT NO. : 4,780,978

DATED : November 1, 1988

INVENTOR(S) : Lauge Sonderbaek

It is certified that error appears in the above-identified patent and that said Letters Patent is hereby corrected as shown below:

On the title page, Column 1, Section [19]:

"Sonderb k" should read as --Sonderbaek--

On the title page, Column 1, Section [75]:

"Lauge Sonderb k" should read as --Lauge Sonderbaek--

Signed and Sealed this

Thirty-first Day of December, 1991

*Attest:*

HARRY F. MANBECK, JR.

*Attesting Officer*

*Commissioner of Patents and Trademarks*